US011247186B2

(12) United States Patent
Topp-Manske

(10) Patent No.: US 11,247,186 B2
(45) Date of Patent: Feb. 15, 2022

(54) MIXING SYSTEM, MIXING DEVICE, CONTAINER, AND METHOD FOR MIXING A FLUID AND/OR A SOLID

(71) Applicant: Sartorius Stedim Biotech GmbH, Goettingen (DE)

(72) Inventor: Simon Topp-Manske, Lohfelden (DE)

(73) Assignee: Sartorius Stedim Biotech GmbH, Goettingen (DE)

( * ) Notice: Subject to any disclaimer, the term of this patent is extended or adjusted under 35 U.S.C. 154(b) by 295 days.

(21) Appl. No.: 15/575,840

(22) PCT Filed: Jul. 11, 2016

(86) PCT No.: PCT/EP2016/001190
§ 371 (c)(1),
(2) Date: Nov. 21, 2017

(87) PCT Pub. No.: WO2017/016640
PCT Pub. Date: Feb. 2, 2017

(65) Prior Publication Data

US 2018/0126345 A1 May 10, 2018

(30) Foreign Application Priority Data

Jul. 30, 2015 (DE) ..... 10 2015 009 895.0

(51) Int. Cl.
*B01F 13/08* (2006.01)
*B01F 7/00* (2006.01)
(Continued)

(52) U.S. Cl.
CPC ..... *B01F 13/0836* (2013.01); *B01F 3/1221* (2013.01); *B01F 7/0025* (2013.01);
(Continued)

(58) Field of Classification Search
CPC ..... B01F 13/0827; B01F 13/0863; B01F 13/0836; B01F 15/00201; B01F 15/00389; B01F 15/0085
(Continued)

(56) References Cited

U.S. PATENT DOCUMENTS 5,061,079 A 10/1991 Shiobara
6,517,231 B1 * 2/2003 Biardeau ..... B01F 13/0818 366/273

(Continued)

FOREIGN PATENT DOCUMENTS

| | | |
|---|---|---|
| DE | 945 183 | 7/1956 |
| DE | 20 2012 104 659 | 5/2004 |
| EP | 2 813 281 | 12/2014 |

OTHER PUBLICATIONS

International Search Report dated Nov. 29, 2016.
German Examination Report dated Mar. 4, 2016.

*Primary Examiner* — Marc C Howell
(74) *Attorney, Agent, or Firm* — Gerald E. Hespos; Michael J. Porco; Matthew T. Hespos

(57) ABSTRACT

The invention relates to a mixing system, in particular a bioreactor and/or a pallet tank, for mixing a fluid and/or solid, having a container (4), wherein the fluid and/or the solid and a rotatable stirring element (3) for mixing the fluid and/or the solid are arranged in the interior of the container (4). The mixing system furthermore has a mixing device (1) for receiving the container (4) and a drive device (2) for driving the stirring element (3). The drive device (2) comprises a stator (20) of a three-phase machine (10; 11), the stirring element (3) comprises a rotor (30) of the three-phase machine (10; 11), and the rotor (30) has at least one permanent magnet (31; 31') and/or at least one short circuit rotor.

17 Claims, 5 Drawing Sheets

(51) Int. Cl.
*B01F 15/00* (2006.01)
*B01F 3/12* (2006.01)

(52) U.S. Cl.
CPC ..... *B01F 7/00633* (2013.01); *B01F 13/0827* (2013.01); *B01F 13/0863* (2013.01); *B01F 15/0085* (2013.01); *B01F 15/00201* (2013.01); *B01F 15/00389* (2013.01)

(58) Field of Classification Search
USPC ..... 366/273, 331
See application file for complete search history.

(56) References Cited

U.S. PATENT DOCUMENTS

| | | | | |
|---|---|---|---|---|
| 2001/0002892 | A1* | 6/2001 | Karkos, Jr. ..... | A23G 9/045 366/274 |
| 2005/0002274 | A1 | 1/2005 | Terentiev | |
| 2006/0131765 | A1* | 6/2006 | Terentiev ..... | B01F 3/04248 261/93 |
| 2010/0008182 | A1* | 1/2010 | Krusche ..... | B01F 13/0818 366/142 |
| 2011/0013474 | A1* | 1/2011 | Ludwig ..... | B01F 3/04269 366/102 |
| 2016/0235251 | A1* | 8/2016 | Carella ..... | A23L 5/15 |

* cited by examiner

MIXING SYSTEM, MIXING DEVICE, CONTAINER, AND METHOD FOR MIXING A FLUID AND/OR A SOLID

BACKGROUND

Field of the Invention

The invention relates to a mixing system, to a mixing device, to a container, and to a method for mixing a fluid and/or a solid.

Description of the Related Art

Mixing systems, such as bioreactors and pallet tanks, are used to receive, to store, and to mix biological media, such as fluids and/or solids. Biological media can be provided in containers, such as bags, which can comprise a volume of several hundred liters. The biological media are introduced inside such a bag into the bioreactor, in which they can be stored, temperature-controlled and/or mixed. Various analyses can be carried on the biological medium in such a bioreactor.

The bioreactor is usually handled in a sterile environment. The mixing of the biological medium can take place by way of a rotating stirring element, which is disposed in the bag and driven from outside the bag. For this purpose, the stirring element making contact with the medium is rotatably driven, without the need to introduce a rotating element, such as a stirring shaft, into the sterile region inside the bag. The drive mechanism of the stirring element does not come in contact with the medium, does not become contaminated, and does not have to be cleaned and/or sterilized for a subsequent process. Moreover, complex sealing on a rotary union into the bag is eliminated.

A mixing device is known from the prior art for this purpose, in which a stirring element making contact with the medium is coupled to an external driving motor via a clutch based on permanent magnets. Two mutually associated clutch halves are equipped with permanent magnets. One of the two mutually opposing clutch halves is disposed inside the bag and designed to make contact with the medium, and the other is disposed outside the bag and designed not to make contact with the medium. The permanent magnets are oriented in such a way that they attract one another and transmit a torque from an outer clutch half driven by the driving motor to an inner clutch half rotating together with the stirring element.

The previously known mixing system comprising the permanent magnets has several disadvantages. So as to transmit high torque, the previously known mixing system must comprise strong, and thus relatively large and expensive, permanent magnets. As a result, the costs for the connecting designs, and for the clutch in particular, are relatively high and are especially significant when bag systems are used, in which the clutch half making contact with the medium, which comprises the expensive permanent magnets, is disposed of.

So as to prevent slipping at the clutch, the magnetic force of attraction of the permanent magnets is designed for the maximum torque to be transmitted. All connection parts present in the power flow during force transmission, such as a housing, a ball bearing, a bag connection and the like, are subjected to the maximum force of attraction of the permanent magnets, regardless of the actually transmitted torque. At lower torque, this may result in unnecessary noise and/or heat build-up, or also in abrasion. Furthermore, the high permanent force of attraction between the clutch halves makes it more difficult to install and remove the bag, since the risk of jamming exists when the clutch halves snap together. Moreover, a high force of attraction must initially be overcome during removal of the bag so as to separate the clutch halves. Additionally, there is the risk that possibly present medical implants of the operating staff are influenced by the strong permanent magnets. Finally, the design comprising a permanent magnet clutch and a separate driving motor causes a relatively large height of the driving device, which may be disadvantageous in particular with low ceiling heights at the usage location of the mixing device.

It is the object of the invention to enable an improved mixing system, which reduces at least one of the above-described disadvantages.

SUMMARY

A first aspect relates to a mixing system, and in particular to a bioreactor and/or a pallet tank, for mixing a fluid and/or a solid, comprising a container, wherein the fluid and/or the solid and a rotatable stirring element for mixing the fluid and/or the solid are provided inside the container. The mixing system comprises a mixing device including a holder for receiving the container and a driving device for driving the stirring element. The driving device comprises a stator of a three-phase machine, and the stirring element comprises a rotor of the three-phase machine. The rotor furthermore comprises at least one permanent magnet and/or at least one squirrel-cage rotor.

The mixing device may in particular be designed as a bioreactor and/or a pallet tank of the type described at the outset. The mixing device comprises a holder into which the container can be introduced. The container contains the fluid and/or the solid that is being mixed in the mixing device. The container may be designed as a flexible bag, which is to say may have a flexible bag wall. Alternatively, the container may comprise substantially stiff and/or rigid container walls, which may be metallic or made of hard plastic, for example. The container may be designed as what is known as a "single-use bag," which is to say as a disposable bag, which may be disposed of after the mixing process. For this purpose, the container may in particular be made of a plastic material, such as a transparent plastic material. In addition to the fluid and/or solid, the container also comprises the stirring element, by way of which a stirring motion is carried out during mixing. For this purpose, the stirring element may in particular comprise a stirring shaft and/or be designed as a stirring shaft.

The holder can be designed to receive and/or mount a predetermined container. If, for example, a flexible bag is provided as the container, the holder may be designed as a substantially rigid receptacle, which is to say have substantially rigid receptacle walls. If a substantially rigid container is provided, the holder may be designed as a mount for the container, comprising stationary coupling attachments for the stirring shaft.

The stirring element is driven by the driving device of the mixing device, which is to say caused to carry out a rotational movement during which the stirring element carries out a turning motion, which is to say a rotational movement, inside the container through the fluid and/or the solid. This mixes the fluid or the solid. The driving device may in particular be disposed adjoining the holder, such as directly above the holder or on and/or in the bottom of the holder. Prior to the start of the mixing process, the stirring element disposed in the container is coupled to the driving device disposed outside the container. The coupling takes place through the container and is designed sufficiently strong to mount an end of the stirring element which faces the driving device on the driving device.

The rotational movement of the stirring element is caused by the three-phase machine, which is operated as an electric motor and drives the stirring element. In particular, the three-phase machine can be operated as a three-phase motor, which is to say with three-phase current using three-phase AC current. As is customary and previously known, the three-phase machine comprises both a stator and a rotor. The stator is an integral part of the driving device. In particular, the driving device can also be designed as the stator. The stator is essentially stationary and, in particular, does not carry out a rotational movement in the terrestrial reference system. The rotor is designed as an integral part of the stirring element and, in particular, the stirring element can be designed as the rotor. The rotor can, in particular, be formed at the end of the stirring element which in an operating position faces the driving device. A rotational movement of the rotor directly causes also a rotational movement of the stirring element and/or of a stirring shaft of the stirring element, which is fixedly connected to the rotor.

On the mixing device, the rotor is coupled to the stator in such a way that, during operation of the three-phase machine, the rotor carries out a rotational movement inside the container. The rotor is coupled to the stator through a wall of the container and/or by way of a wall of the container. The stator can comprise one or more electrical coils, to which electrical current is supplied. The coils may be operated with three-phase current, for example. Magnetic fields are generated by the coils in such a way that these interact with the rotor, which in turn has a magnetic field that is generated by the permanent magnet thereof and/or the squirrel-cage rotor thereof. The interaction of the involved magnetic fields generates the rotational movement of the stirring element.

The principle of a squirrel-cage rotor (also referred to as a short-circuit rotor) is essentially known to a person skilled in the art. In the squirrel-cage rotor, the stator induces current in a permanently short-circuited cage, which includes solid windings. The squirrel-cage rotor thus acts in the manner of a magnet, the magnetic field of which interacts with the magnetic field of the stator, causing the rotor to rotate.

In the mixing system, the driving device is designed as a part not making contact with the medium (also referred to as "not in contact with the medium"). This means that the driving device is not in contact with the fluid and/or solid to be mixed, and in particular not during the mixing process. The stirring element disposed in the container of the mixing system is designed to make contact with the medium (also referred to as "in contact with the medium") and thus is in contact with the fluid and/or solid.

The stator can comprise a coil system, which is supplied with three-phase current via a frequency converter. A magnetic field induced by the three-phase current from the coils of the coil system, which is the so-called stator magnetic field, attracts the permanent magnet and/or the squirrel-cage rotor of the rotor, thereby causing the same to rotate.

The rotor can in particular be designed to be permanent magnet-free and comprise only the short-circuit rotor or squirrel-cage rotor, wherein in this embodiment the rotor magnetic field is caused by the stator magnetic field generated in the coils of the stator and a relative movement of the squirrel-cage rotor, according to the principle of the asynchronous motor.

The stator is designed as an element of the three-phase machine which does not make contact with the medium, and the rotor is designed as an element of the three-phase machine which makes contact with the medium. No separate clutch is necessary, since no torque has to be transmitted from outside the container to the inside, but the torque can be generated by the three-phase machine directly and exclusively inside the container.

An additional (such as external) rotary drive, the torque of which must be transmitted to the stirring element, may be dispensed with in the mixing system according to the invention. In this way, all elements of the mixing device can be designed to be stationary and non-rotating, while only the stirring element carries out a rotational movement during mixing. In particular, no rotational movement of any element whatsoever of the mixing device disposed outside the container is necessary and/or provided.

The driving device can comprise a coil system, which generates a rotating electromagnetic field, as the part not making contact with the medium. Compared to the previously known mixing device, it is therefore possible, for example, for the permanent magnets of the rotor to be designed to be smaller and/or less strong, at the same torque to be transmitted, or can be replaced with a simple and cost-effective metallic rotor, this being the squirrel-cage rotor. This is in particular a cost advantage when using disposable bags as the containers since only less costly permanent magnets or no permanent magnets at all are disposed of. As a result, a cost-effective design, providing space savings and material savings of the connection parts, is made possible.

By controlling the stator, and in particular controlling the three-phase current by way of coils of the stator, the force of attraction between the stator and the rotor can be adapted to the torque required at that moment. In this way, the connection parts of the clutch are only subjected to a high force of attraction when this is in fact required for the transmission of high torque. In this way, noise, heat build-up and abrasion can be reduced.

Since the force of attraction between the stator and the rotor can be controlled by the applied voltage or the three-phase current, the force of attraction can be reduced and/or deactivated during installation and/or removal. In this way, the bag can be safely and easily installed and removed during times at which no mixing takes place, even if the torque to be generated is high during mixing. Due to the thus reduced magnetic fields at the mount, at the three-phase motor and at the drive mechanism, additionally the risk of influence on medical implants of the operating staff is reduced or eliminated.

When using the stator and the rotor as an electromagnetic clutch, an additional rotary drive may be dispensed with, the torque of which would have to be transmitted to the stirring element. By eliminating such an additional external rotary drive, the height of the mixing device can be reduced.

When using an all-metallic rotor comprising no permanent magnets (which is to say the variant in which the rotor comprises only at least one squirrel-cage rotor and no permanent magnet), the disposal of the elements making contact with the medium, which is to say the rotor, is simplified compared to the disposal of a rotor comprising permanent magnets.

In the area not making contact with the medium, the driving device operates substantially wear-free since all rotating elements, which is to say all elements of the stirring element, including of the rotor, are formed in the area making contact with the medium, which can be disposed of together with the container after the mixing process.

According to one embodiment, a rotor magnetic field caused by the rotor interacts with a stator magnetic field generated by the stator during operation of the mixing device. The interaction between the two magnetic fields effectuates the rotational movement of the stirring element. The rotor magnetic field caused by the rotor can be the magnetic field of the at least one permanent magnet of the rotor and/or the magnetic field generated by the at least one squirrel-cage rotor. The two magnetic fields interact with one another according to the principle of the three-phase motor and/or of the asynchronous motor.

According to one embodiment, the stirring element is mounted on the driving device by way of an electrically activatable magnetic force. The stator and the rotor form a clutch of the stirring element to the driving device. The stirring element is mounted, in particular with the rotor, on the stator of the driving device. The stirring element may be mounted so as to be rotatable in a stationary manner. The stirring element rotates about the rotational axis thereof when driven by the driving device. The mounting of the stirring element to the driving device is at least partially magnetic. In addition, the mounting may be mechanically supported. Alternatively, the coupling can take place purely magnetically. In this case, current is supplied to the stator during the installation of the stirring element at least to such an extent that an attraction between the stator and the rotor can be used to securely mount the stirring element. By activating and/or setting the flow of current through the at least one electromagnetic coil of the stator, the magnetic force can be electrically activated.

According to one embodiment, the stirring element is in contact with the fluid and/or solid. The driving device is not in contact with the fluid and/or solid. The stirring element is thus designed as an element making contact with the medium, and the driving device is designed as an element not making contact with the medium. No integral part of the driving device penetrates into the container. Moreover, a particularly efficient separation of the elements of the mixing device is provided. Since no element of the driving device penetrates into the container, the driving device must only satisfy low requirements with regard to sterility and does not have to be cleaned and/or sterilized after every process.

According to one embodiment, the mixing device comprises a control unit for activating at least one electrical coil of the stator. The stator comprises at least the one electrical coil, and preferably several electrical coils. The stator can thus be designed as a coil system comprising multiple electrical coils. A control unit activates the electrical coil(s) of the stator. This activates and/or sets the current and/or the voltage that flows through the electrical coil and/or that is applied thereto. The force of attraction between the stator and the rotor is settable by way of the control unit, in particular during an installation and removal of the stirring element into and from the mixing device. Likewise, the force of attraction during the mixing process is controlled and/or set by way of the control unit. Control can take place, for example, by way of at least one potentiometer and/or digitally by way of an IC and/or a processor, such as a computer. The control unit improves control over the mixing process and/or the installation/removal.

According to one refinement of this embodiment, the control unit controls a force of attraction between the rotor and the stator on the one hand and/or a rotational speed of the rotor on the other hand, and/or sets the same. Controlling the force of attraction is advantageous in particular during the installation and removal of the stirring element onto or into and from the driving device. Controlling and/or setting the rotational speed of the rotor corresponds to controlling and/or setting the rotational speed of the stirring element through the medium, which is to say the fluid and/or the solid. The mixing process is controlled by control of the rotational speed. In this way, substantially complete control over the mixing process is provided, and in particular of the degree, intensity and/or duration of the mixing process.

According to one embodiment, the container is designed as a flexible bag. The mixing device comprises a receptacle for receiving the flexible bag. The receptacle is designed as a holder and is configured to securely mount the flexible bag during stirring. For this purpose, the receptacle can comprise rigid walls, on which elements of the mixing device can be supported and/or mounted.

According to one embodiment, the mixing device comprises a speed monitoring device of the stirring element. The speed monitoring device can have a visual, acoustic and/or inductive design or the like. The speed monitoring device can be designed as part of the above-mentioned control unit. As a result of the speed monitoring device, it is possible, on the one hand, to provide control over the presently achieved rotational speed of the stirring element and, on the other hand, for example, to set a maximum and/or a minimum of a desired rotational speed of the stirring element. In this way, the speed monitoring device can be designed to prevent a maximum speed from being exceeded, for example so as to limit the development of heat and/or abrasion and/or noise.

According to one embodiment, the mixing device has a magnetic force limiting function and/or a torque limiting function of the three-phase motor. The magnetic force limiting function and/or the torque limiting function can be designed as part of the above-mentioned control unit. Similarly to the speed monitoring device, the magnetic force limiting function and/or the torque limiting function can limit and/or reduce the development of heat, noise and/or abrasion on the mixing device. The magnetic force limiting function and/or the torque limiting function can be implemented by a limitation of the three-phase current applied to the stator.

According to one embodiment, the mixing device is designed as a bioreactor, and the fluid and/or the solid is designed as a biological fluid and/or a biological solid. Especially in the case of a bioreactor, the mixing device is particularly efficient and advantageous since all components making contact with the medium must satisfy high sterility requirements in a bioreactor. The driving device, and thus also the stator of the three-phase motor, can be designed as parts of the bioreactor not making contact with the medium, which is why lower sterility requirements must be met for these parts. The bioreactor can comprise further elements, such as a temperature control device and/or feed lines for additional media to be introduced into and discharged from the container.

According to one embodiment, the three-phase machine is designed as an axial three-phase machine, in which a rotational axis of the rotor is oriented substantially parallel to the coil axis of coils of the stator. The coils of the stator are disposed substantially parallel to one another, and in particular in a circle around the rotational axis of the rotor. The rotor can be disposed beneath or above the coils of the stator, for example.

According to an alternative embodiment, the three-phase machine is designed as a radial three-phase machine, in which a rotational axis of the rotor is oriented substantially perpendicularly to the coil axis of radial coils of the stator. In this embodiment, the rotor can be disposed centrally between the circularly inwardly oriented coil axes of the stator, similarly to the traditional electric motor.

A second aspect relates to a mixing device, and in particular to a bioreactor and/or pallet tank, for mixing a fluid and/or a solid, comprising a holder for receiving a container, wherein the fluid and/or the solid and a rotatable element for mixing the fluid and/or the solid are provided inside the container, and a driving device for driving the stirring element. The driving device comprises a stator of a three-phase machine. The driving device is designed and provided to drive the stirring element, which includes a rotor of the three-phase machine, wherein the rotor comprises at least one permanent magnet and/or at least one squirrel-cage rotor. The mixing device according to the second aspect can be designed as part of the mixing system according to the first aspect. For this reason, the comments and exemplary embodiments provided with respect to the mixing device of the mixing system according to the first aspect also relate to the mixing device according to the second aspect.

A third aspect relates to a container for mixing an, in particular biological, fluid and/or an, in particular biological, solid in a mixing device according to the second aspect. The fluid and/or the solid and a rotatable stirring element for mixing the fluid and/or the solid are provided inside the container. The stirring element comprises a rotor of a three-phase machine, wherein the rotor comprises at least one permanent magnet and/or at least one squirrel-cage rotor. The container according to the third aspect can be designed as part of the mixing system according to the first aspect. For this reason, the comments and exemplary embodiments provided with respect to the container, and also with respect to the mixing device of the mixing system, according to the first aspect also relate to the container according to the third aspect.

A fourth aspect relates to a method for mixing an, in particular biological, fluid and/or an, in particular biological, solid, wherein

- a container is provided, wherein the fluid and/or the solid are provided inside the container;
- the fluid and/or the solid are mixed by way of at least one rotatable stirring element disposed inside the container, wherein the stirring element comprises a rotor of a three-phase machine;
- the stirring element is driven by a driving device, wherein the driving device comprises a stator of the three-phase machine; and
- the rotor comprises at least one permanent magnet and/or at least one squirrel-cage rotor.

To carry out the method, in particular a mixing system according to the first aspect can be used. For this reason, all comments and exemplary embodiments provided in connection with the first aspect also relate to the method according to the fourth aspect, and vice versa.

According to one embodiment of the method, the three-phase machine is operated as an electric motor, and in particular as a three-phase motor, for driving the stirring element.

According to one embodiment, the driving device comprises coils, to which respective periodically alternating voltages are applied, so that a first magnetic field is generated by a first of the coils, the progression of this field over time being chronologically offset compared to the progression of at least one second magnetic field of a second of the coils over time. The driving device can, in particular, comprise three coils or an integer multiple of three coils (such as six or nine coils), wherein the coils are fed with a respective line voltage phase of a three-phase system. The coils of the driving device can be disposed in a circle in such a way that the individual magnetic fields of the coils yield an overall magnetic field that essentially has a constant size and/or intensity, and that continuously changes the orientation thereof in keeping with the frequency and/or recurring periods of the three-phase current. If the coils are disposed in a circle, the overall magnetic field "rotates" at a controllable speed in this circle.

The invention will be described hereafter in greater detail based on exemplary embodiments shown in figures. Individual features shown in the figures may be combined with other exemplary embodiments. Identical reference numerals denote identical or similar components of the embodiments.

DETAILED DESCRIPTION

DETAILED DESCRIPTION

Figure 1:
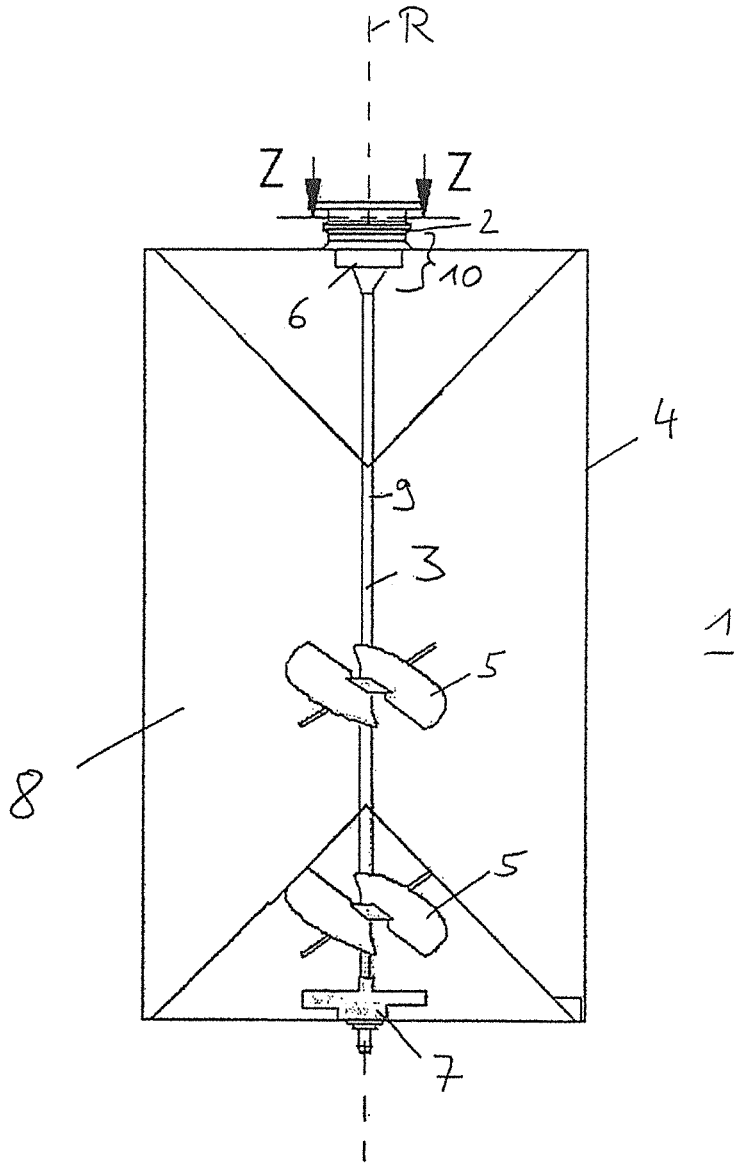
FIG. 1 shows a side view of a mixing system comprising a three-phase motor.

FIG. 1 shows a side view of a mixing system comprising a three-phase motor 10, serving as a three-phase machine. The mixing system comprises a mixing device 1, which is designed and provided to mix a medium 8 provided in a container 4 of the mixing device 1. The medium 8 is a fluid and/or a solid and can, in particular, be designed as a fluid mixture and/or a solid mixture or blend, or else as a mixture of at least one fluid and at least one solid.

In the shown embodiment, the container 4 is designed as a flexible bag and is penetrated by a stirring element 3, which is disposed inside the container 4 and can completely penetrate the container 4 from one end to an opposite end. The stirring element 3 and the medium 8 are provided inside the container, which in turn is introduced and mounted in a holder of the mixing device 1. The holder of the mixing device 1 can be designed as a substantially rigid receptacle in which the container 4 is introduced. The container or bag 4 can be designed as a disposable bag and/or can be disposed of, after the process, together with the residue of the fluid and/or solid and together with the stirring element 3.

The mixing device 1 can be designed as an element of a mixing system comprising the mixing device 1 and the container 4. The mixing device 1 can, in particular, be designed as a bioreactor for receiving, storing and mixing a biological, fluid and/or solid. In other embodiments, the container 4 and the associated receptacle of the mixing device 1 may have other shapes and can, for example, be substantially cylindrical, bucket-shaped, spherical, ellipsoidal, cuboid or the like.

The three-phase motor 10 of the mixing system can be operated with three-phase AC current, which is also referred to as three-phase current. At least three coils (in alternative embodiments, a multiple of three coils) of the three-phase motor 10 are each fed a line voltage phase of a three-phase system, so that a coil magnetic field is generated in and/or by each coil, the progression of which over time is offset by a third of a period from the voltage curve and coil magnetic field of at least two other coils. A "rotating" overall magnetic field is thus created, which is composed of the individual coil magnetic fields and drives the stirring element.

The mixing device 1 furthermore comprises a driving device 2 disposed outside the container 4. The driving device 2 is disposed directly adjoining the container 4. The driving device 2 is disposed essentially in the center of a container wall of the container 4, and in the shown embodiment on the upper container wall of the container 4. The stirring element 3 is coupled to the driving device 2. The stirring element 3 comprises a stirring shaft 9, which is substantially rod-shaped. The stirring shaft 9 is disposed substantially completely inside the container 4 and can either protrude from one end of the container 4 into the container 4 or completely penetrate the container 4 from a first end of the container 4 to a second end of the container 4. In the shown embodiment, the stirring shaft 9 is mounted on two opposing ends of the container 4. The stirring shaft 9 is thus mounted on a drive-side mount 6 and on a counter mount 7. In the embodiment shown in FIG. 1, the drive-side mount 6 is disposed directly adjoining the driving device 2, while the counter mount 7 is disposed on the side of the container 4 located opposite the driving device 2. The drive-side mount can thus be formed at an upper container end of the container 4, and the counter mount 7 can be formed in or on the bottom surface of the container 4. In alternative embodiments, the drive-side mount can also be formed in the bottom of the container 4 or in a side wall of the container 4, while the counter mount is disposed on the respective opposite side of the container.

Multiple stirring appendages 5 are formed on the stirring shaft 9, which during the rotation of the stirring shaft 9 about a rotational axis R of the stirring element 3 move through the medium 8, mixing the medium. The stirring appendages 5 have a propeller-like design in the shown embodiment, which is to say based on the shape of a ship's screw propeller. The stirring appendages 5, however, can also have another shape and be designed to mix the medium 8.

In the shown exemplary embodiment, the rotational axis R is substantially vertical to the terrestrial reference system. The rotational axis R is a rotational axis of symmetry of the rod-shaped stirring shaft 9 and extends substantially perpendicularly away from the driving device 2 (or the container wall on which the driving device is disposed) to the inside of the container 4.

The three-phase motor 10 comprises the driving device 2 and parts of the stirring element 3, in particular parts of the stirring element 3 mounted on the drive-side mount 6. The three-phase motor 10 in particular comprises a stator and a rotor, embodiments of which are described in more detail in the following figures.

Figure 2:
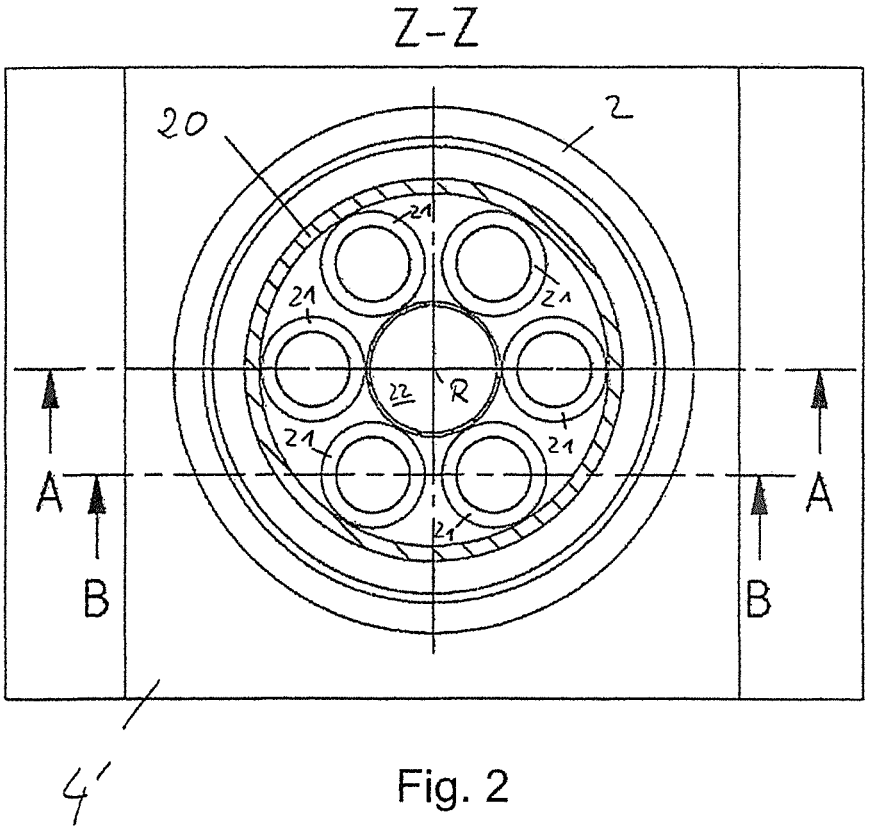
FIG. 2 shows a cross-sectional view through a driving device of a mixing device.

FIG. 2 shows a cross-sectional view through the driving device 2 of the mixing device 1 shown in FIG. 1. The shown cross-section shows a sectional view through a plane Z-Z, which is identified in FIG. 1 and disposed substantially horizontally in the terrestrial reference system through the driving device 2. Moreover, the cutting plane Z-Z extends substantially parallel to the container wall 4' of the container 4 (see FIG. 1) on or in which the driving device 2 is formed. The container wall 4' is the upper container wall of the container 4. Alternatively, another container wall of the container 4 could also be used to dispose the driving device 2 there.

The driving device 2 comprises a stator 20 of the three-phase motor 10, which comprises multiple coils 21. In the shown exemplary embodiment, the stator 20 comprises six substantially equally large and identical coils 21, which are disposed symmetrically about the rotational axis R in a circle. The axes of the coils 21 are disposed parallel to the rotational axis R.

Figure 3A:
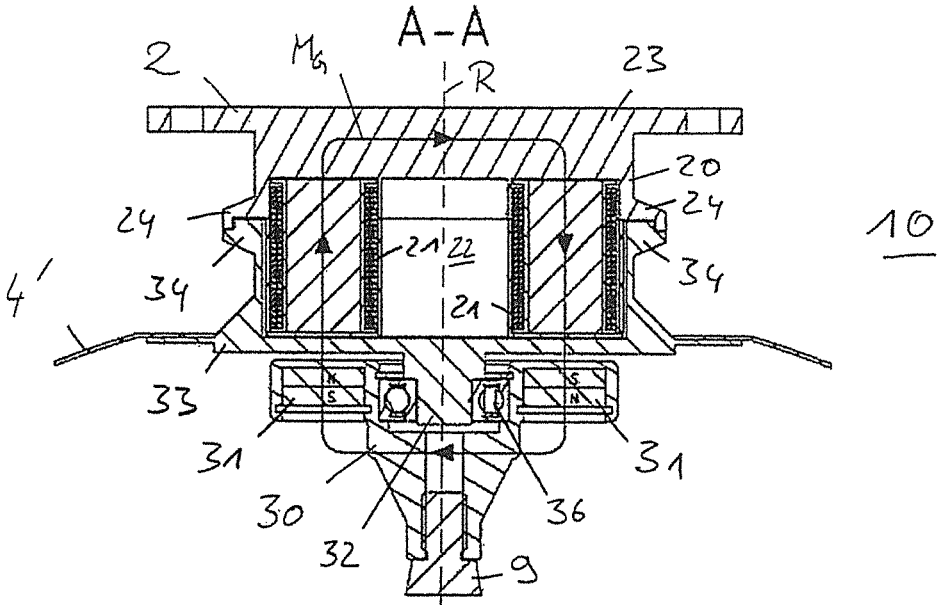
FIG. 3A shows a cross-sectional view through a three-phase motor of a mixing system during operation under magnetic flux through opposing coils.

FIG. 3A shows a cross-sectional view through the three-phase motor 10, and more particularly through the stator 20 and through a rotor 30 of the three-phase motor 10. The rotational axis R is located in the cutting plane of the shown cross-section. The cross-section extends through a plane A-A, which is marked in FIG. 2 and runs perpendicularly through the center of the stator 20. In the embodiment shown in FIG. 1, the axis of intersection is thus a vertical axis of intersection in the terrestrial reference system.

In addition to a coil core 22 and the coils 21, the stator 20 furthermore comprises a stator housing 23 and a clamping protrusion 24. The stator housing 23 is used to securely fix and/or dispose the coils 21 of the stator 20 in a stationary manner. Like the entire stator 20, the stator housing 23 is designed to be stationary and non-rotatable.

The clamping protrusion 24 is formed on the side of the stator housing 23 facing the rotor 30 and is used to mount a rotor housing 33 of the rotor 30. For this purpose, the rotor housing 33 comprises a clamping insert 34, which can be connected to the clamping protrusion 24 of the stator, for example by way of a collar. In the operating state, the clamping protrusion 24 and the clamping insert 34 form a clamping seat in which the rotor housing 33 is rigid clamped to the stator housing 23.

In the shown embodiment, the clamping protrusion 24 and the clamping insert 34 are designed so as to completely extend around the three-phase motor 10. In other embodiments, the clamping protrusion and the clamping insert may extend around the three-phase motor only partially, be formed only in individual locations of the housings and/or another attachment for mounting the rotor housing 33 to the stator housing 23 may be provided.

The rotor housing 33 penetrates the container wall 4' at an opening and is mounted and/or attached to the stator housing 23 in this opening of the container wall 4'. The rotor housing 33 comprises a stationary pin 32, the center line of which coincides with the rotational axis R and which (like the rotor housing 33) is designed to be stationary and non-rotatable. A ball bearing 36, which can rotate around the stationary pin 32 and around the rotational axis R, is disposed around the stationary pin 32. Multiple permanent magnets 31 of the rotor 30, which are able to move around the stationary pin 32 and, in this process, carry out a rotational movement about the rotational axis R, are mounted on the ball bearing 36. The permanent magnets 31 form a rotating part of the rotor 30 to which the stirring shaft 9 is rigidly coupled. Upon rotation of the rotor 30, or more precisely of the permanent magnets 31, about the rotational axis R, the stirring shaft 9 thus also rotates about the rotational axis R.

In an alternative embodiment, the rotor is mounted by way of a different mounting, for example without a pin and with outside bearings, in the rotor housing.

FIG. 3A furthermore shows a magnetic flux MG through opposing coils 21 of the stator 20 and through opposing permanent magnets 31 of the rotor 30. In the activation of the three-phase motor 10 shown in FIG. 3A, the magnetic flux MG thus flows through opposing coils and opposing permanent magnets.

Alternatively, the same three-phase motor 10 can also be activated in such a way that a magnetic flux MN takes place through adjoining coils 21 of the stator 20 and through adjoining permanent magnets 31 of the rotor 30. This activation is shown in the cross-sectional view through the three-phase motor 10 shown in FIG. 3B. The cross-section shown in FIG. 3B is parallel offset from the cross-section shown in FIG. 3A and shows a sectional view through a cutting plane B-B, which is likewise shown in FIG. 2.

Figure 3B:
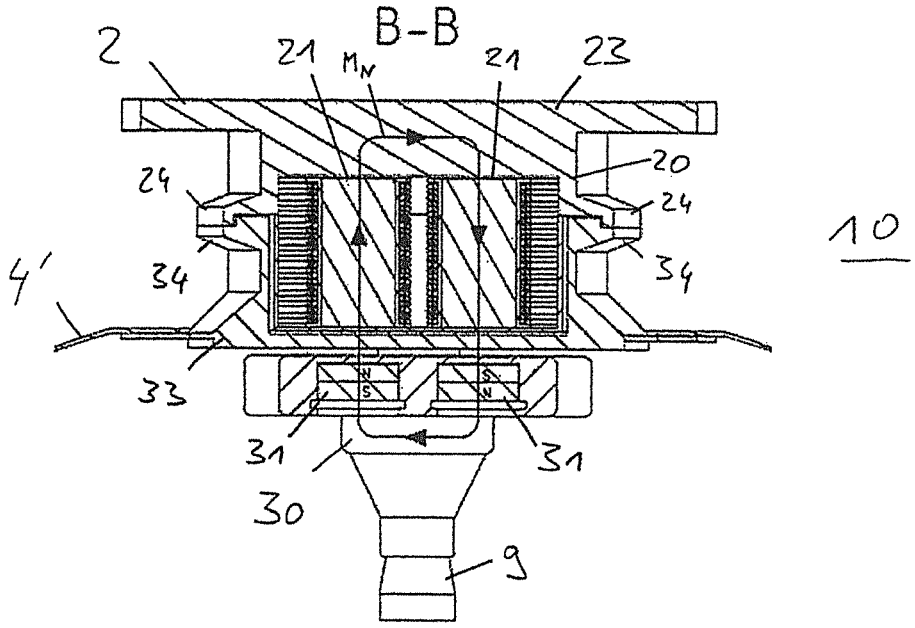
FIG. 3B shows a cross-sectional view through a three-phase motor of a mixing system during operation under magnetic flux through adjoining coils.

By way of a control unit, which is not shown in the figures, the coils 21 of the three-phase motor 10 can be selectively activated as shown in FIG. 3A or as shown in FIG. 3B. Moreover, the control unit can be used to set the current intensity, and thus the force of attraction between the coils 21 and the permanent magnets 31. The shown three-phase motor 10 can be used to drive the stirring shaft 9 mounted in the area making contact with the medium, without a rotating element of the drive mechanism having to be introduced through the bag 4 into the sterile area, for example. The drive mechanism thus does not come in contact with the medium, does not become contaminated, and does not have to be cleaned and/or sterilized for a subsequent process. Furthermore, complex sealing of a rotary union into the area making contact with the medium is eliminated.

As shown in FIGS. 3A and 3B, the magnetic fields $M_G$ and/or $M_N$ can have different designs, and more particularly as a function of the geometric arrangement and electrical activation of the coils 21 and the design of the rotor 30. The arrangement and interconnection may be optimized so as to effectuate a magnetic flux through two adjoining coil magnet pairs or through two opposing coil magnet pairs. Each of the coils 21 is activated in such a way that the rotor 30 is displaced in a desired direction of rotation about the rotational axis R by the generated magnetic field, which is to say the magnetic field thus forms between the next coil pair in the direction of rotation and the next permanent magnets. The rotor 30 synchronously follows the rotating field of the coils 21.

In an alternative embodiment of the rotor, the rotor does not comprise any permanent magnets, but one or more squirrel-cage rotors. A flow of current, which induces a magnetic field in the rotor, is created in the rotor, which is composed of laminated cores comprising short-circuited windings and/or composed of a cast core, by way of a rapidly rotating magnetic field of the coils 21. Due to the force of attraction between the rotating field of the coils of the stator and the induced magnetic field in the rotor, the rotor follows the rotating field. The rotor follows the rotating field asynchronously, which is to say at a lower rotational speed than the rotational speed of the rotating field.

Figure 4:
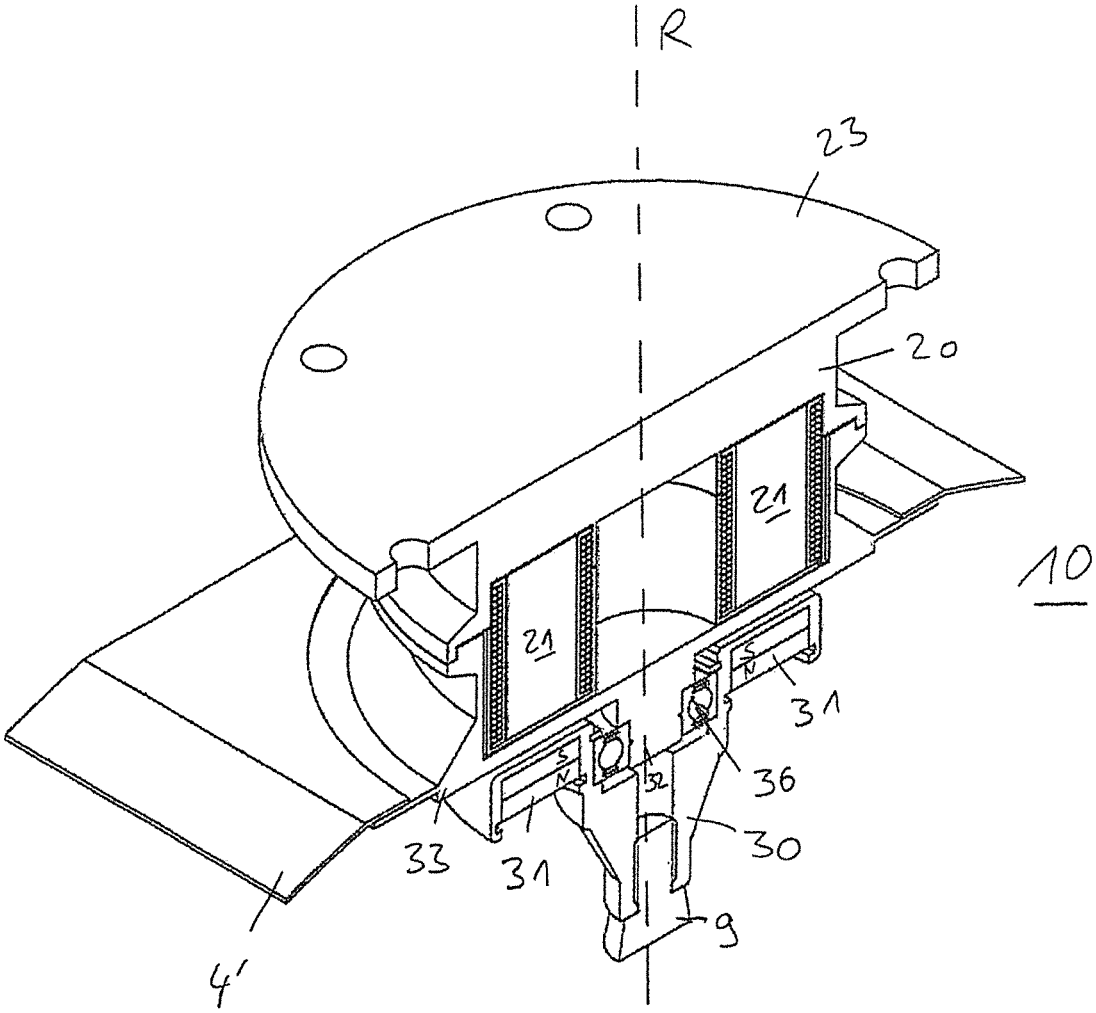
FIG. 4 shows a sectional illustration of an axial three-phase motor of a mixing system.

FIG. 4 shows a sectional view through an axial three-phase motor 10 of a mixing device. The axial three-phase motor 10 corresponds to the three-phase motor 10 shown in FIGS. 2, 3A and 3B. The shown cutting plane extends through to the rotational axis R. In the axial three-phase motor 10, the axes of the coils 21 are disposed substantially parallel to the rotational axis R, and the permanent magnets 31 of the rotor 30 are disposed substantially parallel to the rotational axis R. The "orientation of the permanent magnets" shall be understood to mean the orientation of magnetic north to magnetic south. In the embodiment shown in FIG. 4, the magnetic souths are provided exactly above the magnetic norths, and more particularly parallel to the rotational axis R. The three-phase motor 10 is thus designed as what is known as an axial three-phase motor 10.

Figure 5:
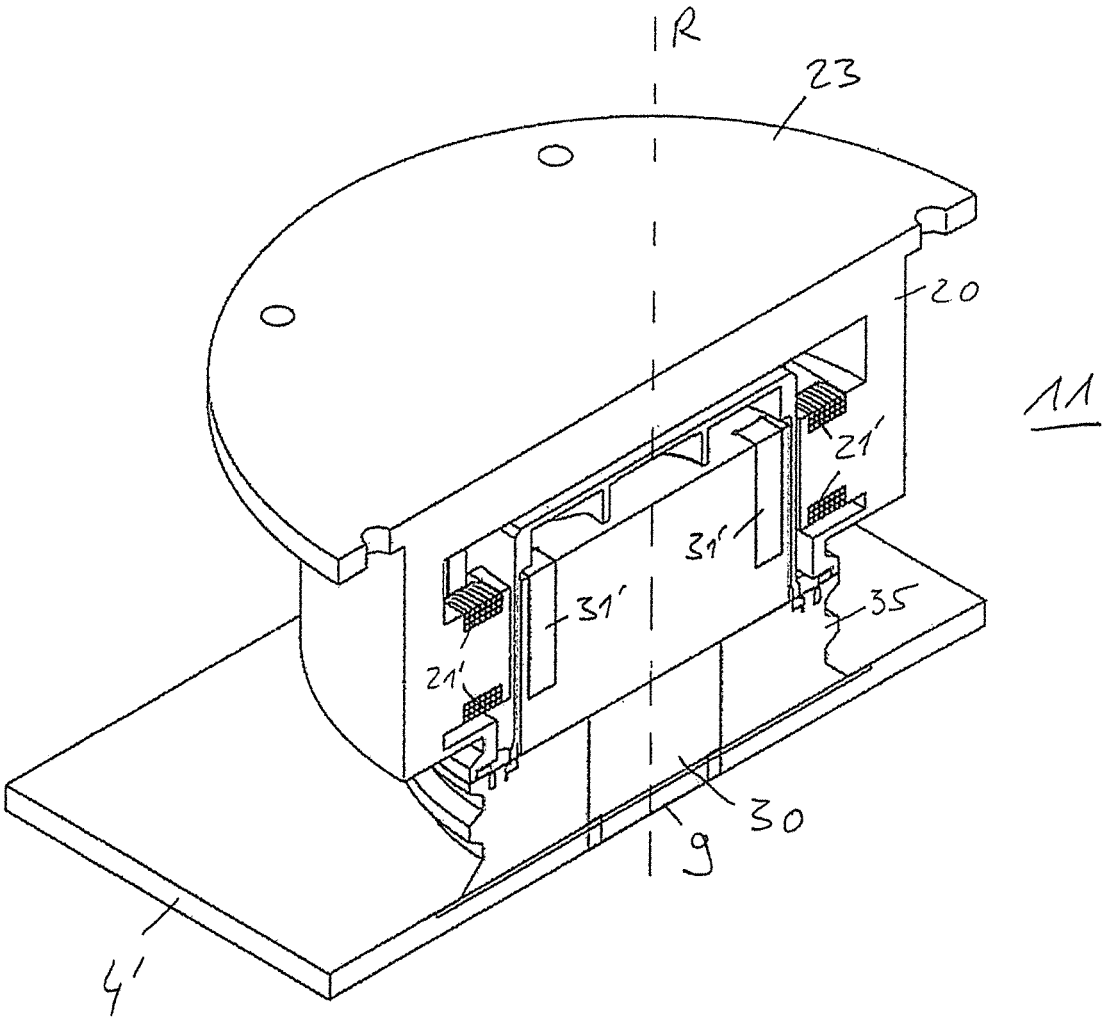
FIG. 5 shows a sectional illustration of a radial three-phase motor of a mixing system.

FIG. 5 shows a radial three-phase motor 11. The radial three-phase motor 11 resembles the axial three-phase motor 10 and comprises several identical or similar components. The cutting plane of the cross-section shown in FIG. 5 includes the rotational axis R. The stator 20 comprises radial coils 21', the coil axes of which are disposed substantially perpendicular to the rotational axis R. More precisely, the radial coils 21' are disposed in a circle around the rotational axis R in such a way that the coil axes thereof point substantially perpendicular to the rotational axis R. When current flows through the radial coils 21', a magnetic field is generated, which is to say a stator magnetic field, which interacts with radial permanent magnets 31' of the rotor 30. The radial permanent magnets 31' are also disposed in a substantially circular manner and perpendicularly to the rotational axis R. Either magnetic north or magnetic south points outwardly in the direction of a radial coil 21'.

In the radial three-phase motor 11, the rotor 30 engages completely in a recess of the stator 20, wherein the rotor 30 is mounted at least partially inside of the stator 20. As in the above-described embodiment, a rotational movement of the rotor 30 about the rotational axis R effectuates turning (a rotation) of the stirring shaft 9, to which the rotor 30 is coupled. The rotor 30 is mounted on a rotor mount 35, which has an opening through which the stirring shaft 9 is coupled to the head of the rotor comprising the radial permanent magnets 31'. The rotor mount 35, forming a part of a rotor housing, is connected to the container wall 4', has a stationary and non-rotatable design, and can form a clamping seat with the stator housing 23.

The clutch between the rotor and the stator can thus be either axial, for example as is the case with the axial three-phase motor 10, which is shown in FIG. 4, or it can be radial, for example as is the case with the radial three-phase motor 10, which is shown in FIG. 5. In both embodiments, the rotor 30, the stirring shafts 9, and in particular the permanent magnets 31 or 31', which is to say the entire stirring element 3, are disposed inside the container 4 and thus designed to make contact with the medium. The stator housing 23 can have an optimized design for the interconnection of the coils 21 or 21', and the position of the permanent magnets or squirrel-cage rotors.

Both in the case of the axial three-phase motor and in the case of the radial three-phase motor, the stator housing (not making contact with the medium) may form a clamping connection with the rotor housing (making contact with the medium). The rotor housing 33 is designed to be stationary and non-rotatable and serves as a stationary and non-rotatable mount for the stirring shafts 9 and the permanent magnets 31, 31' or the squirrel-cage rotor or rotors.

Instead of a clamping connection between the stator housing and the rotor housing, screw joints, magnetic couplings and/or other attachments may be provided. The stirring shaft 9 can be mounted on the driving device 2 on the one hand, and also on a counter mount 7, on the other hand, as shown in FIG. 1. Alternatively, the stirring element 3 can only be mounted on one side, this being the drive-side mount 6. In such an embodiment, the stirring element does not penetrate the container 4 completely, but only protrudes from a container wall of the container 4 into the inside of the container 4. The double mounting, which is to say the mounting on opposing walls of the container 4, however, increases the stability of the stirring shaft during the rotational movement thereof.

LIST OF REFERENCE SIGNS

1 mixing device
2 driving device
3 stirring element
4 container or bag
4' container wall
5 stirring appendage
6 drive-side mount
7 counter mount
8 medium
9 stirring shaft
10 axial three-phase machine
11 radial three-phase machine
20 stator
21 coil
21' radial coil
22 coil core
23 stator housing
24 clamping protrusion
30 rotor
31 permanent magnet
31' radial permanent magnet
32 stationary pin
33 rotor housing
34 clamping insert
35 rotor mount
36 ball bearing
R rotational axis
$M_G$ magnetic flux through opposing coils
$M_N$ magnetic flux through adjoining coils

The invention claimed is:

1. A mixing system for mixing a fluid and/or a solid, comprising:

a container (4) configured for containing the fluid and/or the solid;

a rotatable stirring element (3) provided inside the container (4) and configured for mixing the fluid and/or the solid inside the container (4), the rotatable stirring element (3) comprising a stirring shaft (9) having opposite first and second ends and defining a rotational axis (R), the first and second ends of the stirring shaft (9) being connected respectively to a drive side mount (6) and a connector mount (7) at opposite positions in the container (4); and a driving device (2) for driving the stirring element (3), wherein the driving device (2) comprises:

a three-phase machine (10; 11) having a stationary and non-rotatable stator housing (23) disposed at a position external of the container (4), and a stator (20) disposed in the stator housing (23);

a rotor housing (33) mounted to the container (4), the rotor housing (33) having a stationary portion fixed relative to the stator housing (23) and a rotatable portion disposed in the container (4) and being rotatable about the rotational axis (R), the rotatable portion of the rotor housing including the drive side mount (6) to which the first end of the stirring shaft (9) is connected; and a rotor (30) of the three-phase machine (10; 11), the rotor (30) comprising permanent magnets (31; 31') and/or at least one squirrel-cage rotor, the rotor (30) being mounted to the rotatable portion of rotor housing (33) for rotation with the rotatable portion of the rotor housing (33) and being disposed in the container (4) at a fixed axial position relative to the rotational axis (R) so that operation of the three-phase machine (10; 11) causes the rotor (30) to generate torque inside the container (4);

wherein the three-phase machine (10; 11) generates a torque exclusively inside the container, and the torque rotates the rotor (30) relative to the stator (20) in response to operation of the driving device (2).

2. The mixing system of claim 1, wherein a rotor magnetic field caused by the rotor (30) interacts with a stator magnetic field generated by the stator (20) during operation of the mixing device (1).

3. The mixing system of claim 1, wherein the stirring element (3) is mounted on the driving device (2) by way of an electrically activatable magnetic force.

4. The mixing system of claim 1, wherein the stirring element (3) is in contact with the fluid and/or solid, and the stator (20) of the driving device (2) is not in contact with the fluid and/or solid.

5. The mixing system of claim 1, comprising a control unit for activating at least one electrical coil (21; 21') of the stator (20).

6. The mixing system of claim 5, wherein the control unit controls and/or sets a force of attraction between the rotor (30) and the stator (20) and a rotational speed of the rotor (30).

7. The mixing system of claim 1, wherein the container (4) is a flexible bag.

8. The mixing system according to of claim 1, comprising a magnetic force limiting function and/or a torque limiting function of the three-phase machine (10; 11).

9. The mixing system of claim 1, wherein the mixing device (1) is a bioreactor, and the fluid and/or the solid is a biological fluid and/or a biological solid.

10. The mixing system of claim 1, wherein the three-phase machine is an axial three-phase machine (10), and the rotor (30) has a rotational axis (R) oriented substantially parallel to coil axes of coils (21) of the stator (20), wherein the magnets (31, 31') of the rotor (30) are disposed to align with the coil axes of the coils (21).

11. The mixing system of claim 1, further comprising stirring appendages (5) projecting from the rotatable stirring shaft (9) and configured for stirring contents of the container (4).

12. The mixing system of claim 1, wherein the stationary portion of the rotor housing (33) is fixed to the stator housing (23) by a clamping connection.

13. The mixing system of claim 1, wherein the stationary portion of the rotor housing (33) is fixed to the stator housing (23) by screw joints.

14. The mixing system of claim 1, wherein the stationary portion of the rotor housing (33) is fixed to the stator housing (23) by magnetic couplings.

15. A method for mixing a fluid and/or a solid, comprising:

providing a container (4) with a container wall, a rotor housing (33), a rotor (30) and a rotatable stirring element (3), the rotor housing (33) having a non-rotatable portion fixed in a stationary and non-rotatable manner to the container wall of the container (4), the rotor housing (33) further having an internal portion inside the container (4) and rotatable with respect to the non-rotatable portion of the rotor housing (33), the rotor (30) being mounted to the internal portion of the rotor housing (33) for rotation with the rotatable portion of the rotor housing (33), the rotatable stirring element (3) comprising a stirring shaft (9) having opposite first and second ends, the first end of the stirring shaft (9) being connected in an axially fixed position to a drive side mount (6) on the rotatable portion of the rotor housing (33), the second end of the stirring shaft (9) being connected to a connector mount (7) on a side of the container (4) opposite the drive side mount (6), the rotor (30) being connected to and arranged at the first end of the stirring shaft (9) so that the rotor (30) and the stirring element (3) are rotatable in unison;

providing a stator (20) of a three-phase machine (10; 11), the stator (20) comprising a stator housing (23);

connecting the stator housing (23) to the external portion of the rotor housing (33) in an axially fixed non-rotatable position so that the stator (20) is opposed to the rotor (30) and so that the stator (20) and the rotor (30) form a driving device (2);

placing the fluid and/or the solid into the container (4); and operating the three-phase machine (10; 11) so that the rotor (30) of the three-phase machine (10; 11) on the interior of the container (4) generates a torque exclusively inside the container (4), with the torque of the rotor (30) rotating the stirring element (3) in the interior of the container (4) while keeping the stirring element (3) in the axially fixed position and thereby mixing the fluid and/or the solid disposed inside the container (4).

16. The method of claim 15, wherein the three-phase machine (10; 11) is operated as an electric motor for driving the stirring element (3) and/or wherein the driving device (2) comprises coils (21; 21'), to which the respective periodically alternating voltages are applied, so that a first magnetic field is generated by a first of the coils (21; 21'), the progression of this field over time being chronologically offset compared to the progression of at least one second magnetic field of a second of the coils (21; 21') over time.

17. A mixing system for mixing biological media, comprising:

a container (4) configured for containing the biological media;

a rotatable stirring element (3) provided inside the container (4) and configured for mixing the biological media inside the container (4), the rotatable stirring element (3) comprising a stirring shaft (9) having opposite first and second ends and defining a rotational axis (R), the first and second ends of the stirring shaft (9) being connected respectively to a drive side mount (6) and a connector mount (7) at opposite positions in the container (4); and a driving device (2) for driving the stirring element (3), wherein the driving device (2) comprises:

a three-phase machine (10; 11) having a stationary and non-rotatable stator housing (23) disposed at a position external of the container (4), and a stator (20) disposed in the stator housing (23), the stator (20) having coils (21) with axes aligned substantially parallel to the stirring shaft (9);

a rotor housing (33) mounted to the container (4), the rotor housing (33) having a stationary portion fixed relative to the stator housing (23) and a rotatable portion disposed in the container (4) and being rotatable about the rotational axis (R), the rotatable portion of the rotor housing including the drive side mount (6) to which the first end of the stirring shaft (9) is connected; and a rotor (30) of the three-phase machine (10; 11), the rotor (30) comprising permanent magnets (31; 31') positioned to be aligned with the axes of the coils (21) of the stator (20), the rotor (30) being mounted to the rotatable portion of rotor housing (33) for rotation with the rotatable portion of the rotor housing (33) and being disposed in the container (4) at a fixed axial position relative to the rotational axis (R) so that operation of the three-phase machine (10; 11) causes the rotor (30) to generate torque inside the container (4);

wherein the three-phase machine (10; 11) generates a torque exclusively inside the container, and the torque rotates the rotor (30) relative to the stator (20) in response to operation of the driving device (2).

* * * * *